United States Patent [19]

Gutermuth et al.

[11] 4,401,165

[45] Aug. 30, 1983

[54] FIRE RESISTANT SUB-CEILING

[76] Inventors: Paul Gutermuth, Augustastrasse 48, D-6456 Langenselbold; Heinrich Oetjen, Lindenallee 38, D-6456 Bruchköbel, both of Fed. Rep. of Germany

[21] Appl. No.: 255,859

[22] Filed: Apr. 20, 1981

[30] Foreign Application Priority Data

Apr. 21, 1980 [DE] Fed. Rep. of Germany ..... 3015305

[51] Int. Cl.[3] ..... A62C 35/00; A62C 39/00

[52] U.S. Cl. ..... 169/54; 169/5; 169/51; 52/14; 52/168

[58] Field of Search ..... 169/5, 16, 43, 45, 48, 169/54, 70; 52/14, 80, 173 R, 168, 56

[56] References Cited

U.S. PATENT DOCUMENTS 3,892,277 7/1975 Curran ..... 169/16

4,194,325 3/1980 Chalpin ..... 52/14

*Primary Examiner*—Joseph J. Rolla

*Assistant Examiner*—Charles C. Compton

*Attorney, Agent, or Firm*—Dennison, Meserole, Pollack & Scheiner

[57] ABSTRACT

A system for increasing the fire resistance of support ceilings and limiting damage caused by water as a result of fire-extinguishing operations to the respective localities. The system including a suspended fire resistant covering with sprinkler elements, the covering being composed of arched ceiling elements along which the liquid travels, the ceiling elements having side edges accommodated by collecting channels which receive the liquid coming from the sprinkler elements. A distance is maintained between side edges and the walls of the collecting channels for liquid flow into the channels and exhaust air flow upward through the covering.

10 Claims, 5 Drawing Figures

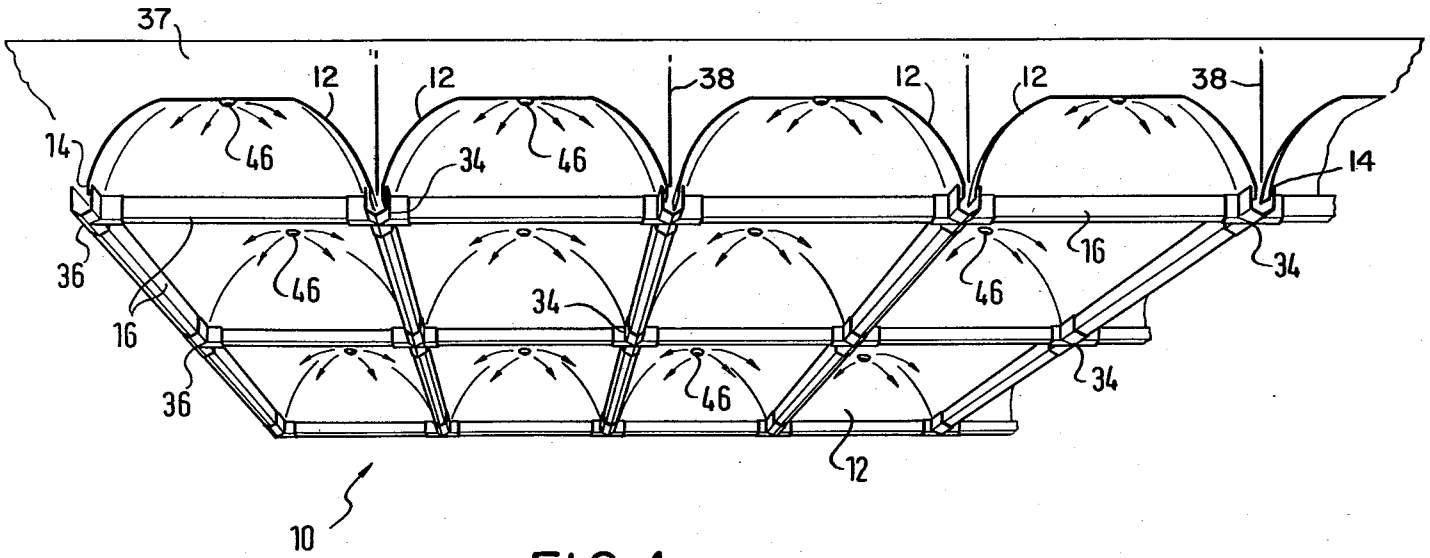
FIG. 1
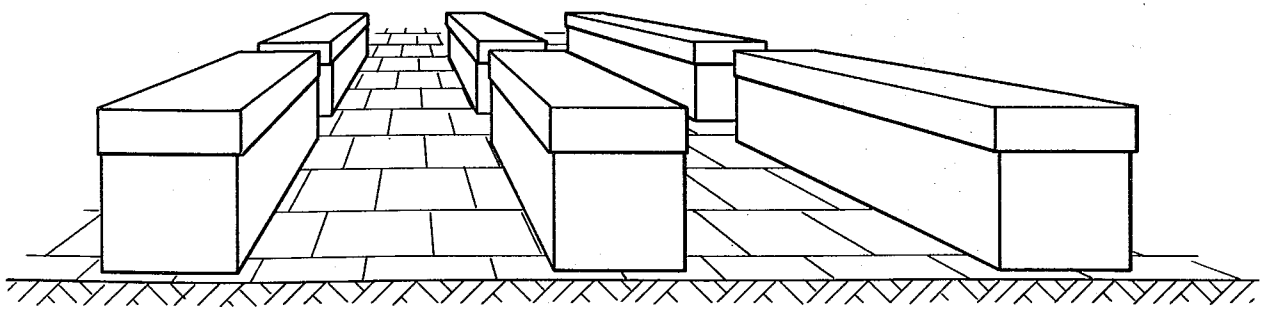

FIRE RESISTANT SUB-CEILING

The invention relates to a suspended, fire-resistant covering for supporting ceilings. The covering is provided with sprinkling elements, and a suction opening of an exhaust fan is arranged above the covering.

Conventional fire-resistant coverings, configured e.g. as suspended ceilings, serve to increase the fire resistance of the supporting ceilings. Thereby, special attention is given to preventing the fire from coming into direct contact with the supporting ceiling. Very often, such coverings are also equipped with sprinkler systems, and that means that at a certain temperature sprinkling heads will be automatically actuated in order to check local heat evolution or build-up. The liquid discharged by the sprinkling heads is directed directly to the floor area of the room to be protected.

However, it has become apparent that high material damage does not necessarily occur as a result of the fire but rather as a result of the subsequent fire extinguishing actions. Especially for example in warehouse or department stores, it has become obvious that the damage resulting from a fire was rather insignificant as compared with the damage caused by the water from the fire extinguishing operations. In such cases, the damage caused by water occurs not only in those floors where the fire has been extinguished but also in the lower areas, since the water often can drain off through the floors into lower stories.

Therefore, it is the object of the present invention to supply a suspended, fire-resistant covering provided with sprinkling elements for supporting ceilings, by which the fire resistance capacity of the supporting ceilings shall be increased, and which it will guarantee that damage caused by water is locally limited, and thus the extinguishing water cannot cause any damage in the stories located below the scene of the fire. Also, the fire damps developing in the fire centers can be rapidly exhausted by means of standard exhaust fans with suction openings arranged above the fire-resistant covering.

This object is realized by the invention in that the covering is composed of arched ceiling elements, the side edges of which are accommodated in collecting channels for liquids discharged by the sprinkling elements, preferably in the form of sprinkler heads or nozzles. The liquid collects in the channels by maintaining a distance between the walls of the collecting channels and to the side edges of the respective adjacent ceiling elements. One advantage of the covering according to this invention is that the ceiling elements can be sprayed with liquids, to increase the fire resistance. Also, the continuously renewed water with its controlled drain-off represents an extremely effective energy absorber and smoke emission carrier. Thereby, the water delivered by the sprinkler heads will flow into the collecting channels, in which the side edges of the ceiling elements are arranged. The suction openings of the exhaust fans, being arranged as known in the area of the supporting ceilings, then suck off the air through slits formed between the side edges of the ceiling elements and the side walls of the collecting channels. The rapid and total suction of the air and/or the smoke through the slits can be explained as follows: A hollow space is formed between the structural members defining the room and the covering. In this space the flow resistance is considerably less than in the slits that can be characterized as exhaust joints. For this reason, a vacuum is generated in the hollow space of the ceiling, providing a uniform suction over the total area of the covering. Without the covering according to the invention, the air and/or the smoke is distributed throughout the room. While passing through the exhaust joints with liquids, therein, the smoke and/or fumes are cooled off so that the conventional exhaust fans will still keep up their functional capabilities. If this appropriate cooling did not take place, it is likely the high temperatures would cause the suction fans to go out of operation. As a consequence, there would be a still further spread of the smoke and/or fumes over the entire room.

In one embodiment of the invention, the ceiling elements can be arched in the shape of a cross arch, a barrel, or a groove. Thereby the shape of the ceiling elements, on the one hand, can be designed for simple manufacture, and on the other hand with a view to their decorative effect, in order to be integrated e.g. with the selling area of a department store floor as a decorative element.

The sprinkling elements can be configured in such a manner as to allow for a sprinkling of the surface turned toward the room and also of the surface turned toward the ceiling. Thereby the fire resistance capacity will be increased.

If the ceiling elements are vaulted like a cross arch, the collecting channels are connected with each other by means of cruciform connecting pieces or, respectively, T-shaped connecting pieces on the ceiling edges at the cross points. Retaining plates can be mounted in these pieces preferably at different levels to dam the liquid. By this method, one can achieve the advantage that when a fire breaks out, an increased intake of energy by the liquid can take place by raising the level of the liquid. Also, the level of the liquid can be adjusted by means of the retaining plates in such a manner as to seal the slit between the walls of the collecting channels and the side edges of the ceiling elements. The sucked-off air or the sucked-off fumes will be cooled off even more upon passing therethrough.

Preferably, a cruciform connecting piece is pressed from below against the collecting channels and has a borehole through which a plug bolt or the like passes to affix the covering onto the supporting ceiling. The plug bolt engages a borehole of a cruciform suspension piece having arched legs, pressing from above against the collecting channels in the area of the joints of the ceiling elements. To keep the distance between the collecting channels and the ceiling elements, a cruciform or T-shaped support piece at each of the cross points of the collecting channels accommodates the edges of the ceiling elements, which support has a borehole to accommodate a plug bolt or the like.

In case of a fire, to prevent plaster crumbling away from the supporting walls or cable laid along them from getting into the area between the collecting channels and the ceiling elements and thus obstruct the suction of air or fumes, the ceiling elements in the area of the collecting channels are provided with ceiling-side dirt traps, preferably in the form of a protective screen.

Still another advantage is achieved with the covering according to the invention, in that water seeping through a ceiling cannot enter the floor area of the screened off room, but rather the water is drained off along the ceiling-side surface of the ceiling elements into the collecting channels, so as to be led for example to a spout pipe, into which the collecting channels discharge.

Consequently, the teaching according to the invention makes available a covering of simple construction which not only increases the fire resistance capacity of the supporting ceilings but also at the same time prevents that extinguishing water from one story reaching the floor area of the next lower story.

Preferably, the lower edges of the collecting channels should be arranged at equal distance from the floor. Thus, the intersecting collecting channels can be U-profiles of which the crosspieces are arranged in a common plane, while the collecting channels themselves are subdivided into first and second collecting channels, being arranged parallel to each other. In a corresponding embodiment, the second collecting channels can then be nested in notches provided in the sides of the first collecting channels of the width of the second collecting channels. In order to drain off the liquid collected in the collecting channels without any difficulty, and especially in order to properly deliver the liquid from the second collecting channels to the first collecting channels, the second collecting channels are provided with an intermediate bottom running parallel to the crosspieces at some distance therefrom, which are at the level between the crosspieces and the notch of the first collecting channels. Preferably, the first collecting channels having the notches will be connected with supporting elements.

In another embodiment of the invention, sleeves extend from the crosspieces of the first collecting channels at least up to the upper edges of the legs, where the openings all the way through the sleeves are designed for the lodging of fixation elements for the covering or for leading supply lines through them. In still another embodiment of the invention, the piping for the supply of liquid to the sprinkling heads serves at the same time as suspension for the covering.

Further details, advantages and characteristics of the invention will be apparent from the following description of the drawings, wherein:

FIG. 1 is a perspective view of a room with a covering according to the invention, partially in cross section;

In a story of a department store, for example, a suspended covering 10, composed of individual ceiling elements 12, is provided below a supporting ceiling. Elements 12 are preferably made of thin-walled material. In the embodiment of FIG. 1, the ceiling elements 12 are arched like a cross arch. The edges at the opening of the cross-arched vault can be of equal length, so that each ceiling element 12 will define a square surface on a level running parallel to the floor area of the salesroom. Of course, the base surface of ceiling elements 12, arched like a cross arch, can also be rectangular or trapezoidal. Ceiling elements 12 are arranged side by side at the same height.

Figure 2:
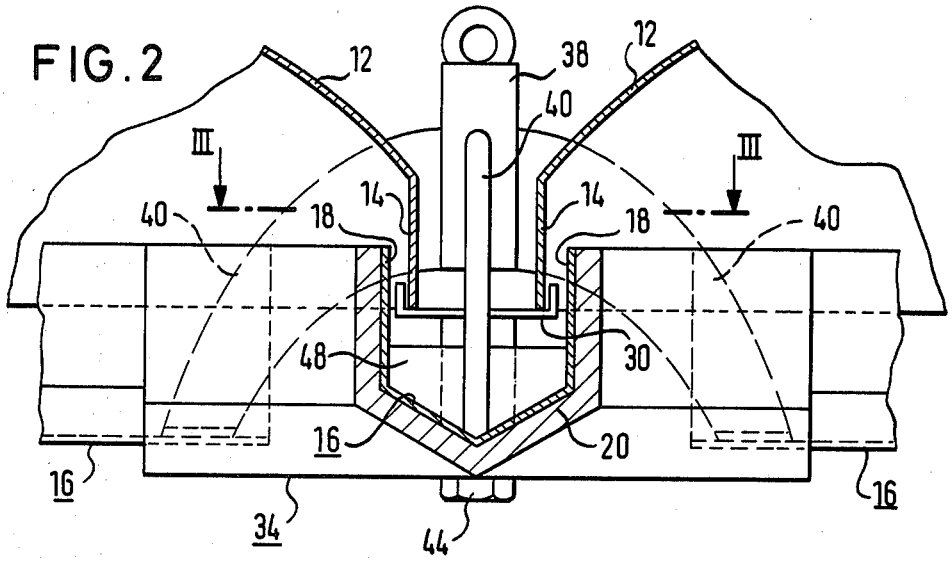
FIG. 2 is a cross section representation of a cross point of collecting channels and the adjacent sections of four ceiling elements.
Figure 3:
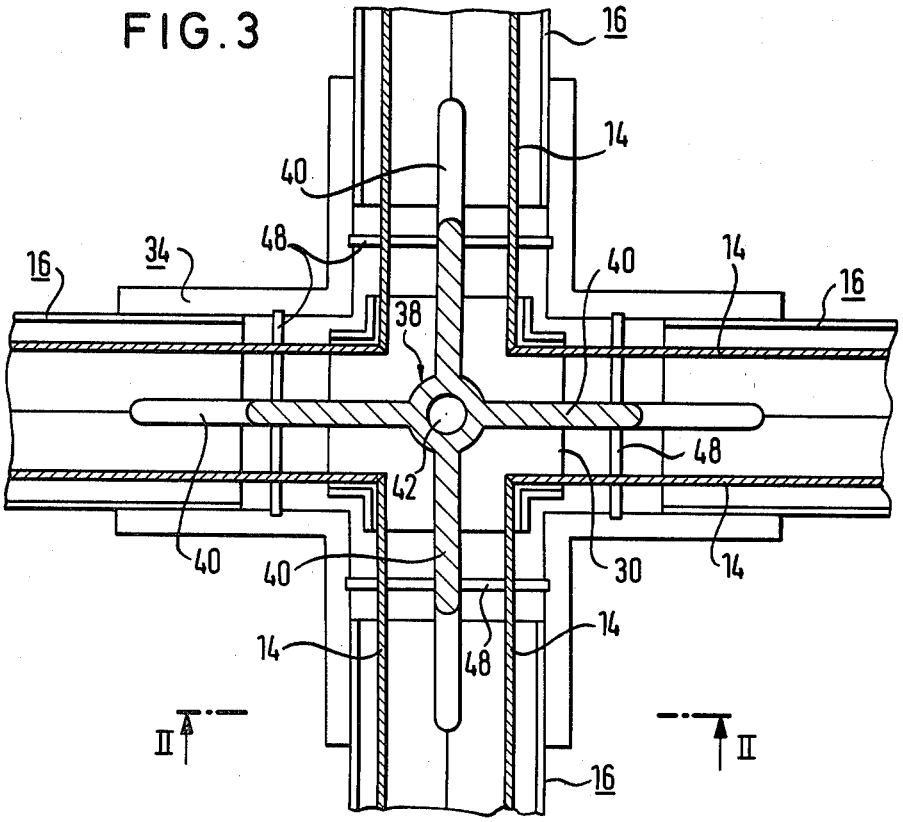
FIG. 3 is a partial cross section representation of the crossing point as in FIG. 2, in top view.
Figure 4:
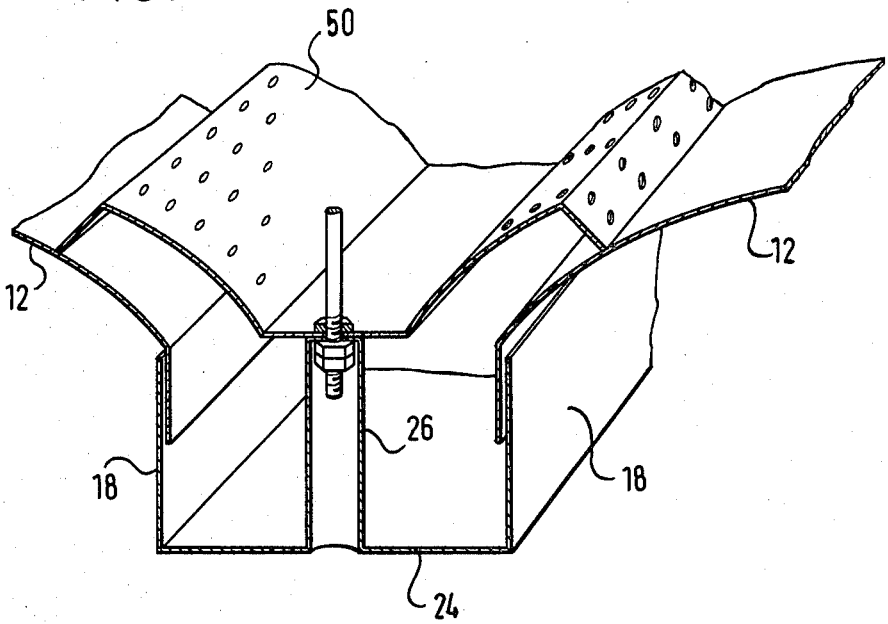
FIG. 4 is a partial cross section representation of the area between the subceiling elements and the collecting channel.
Figure 5:
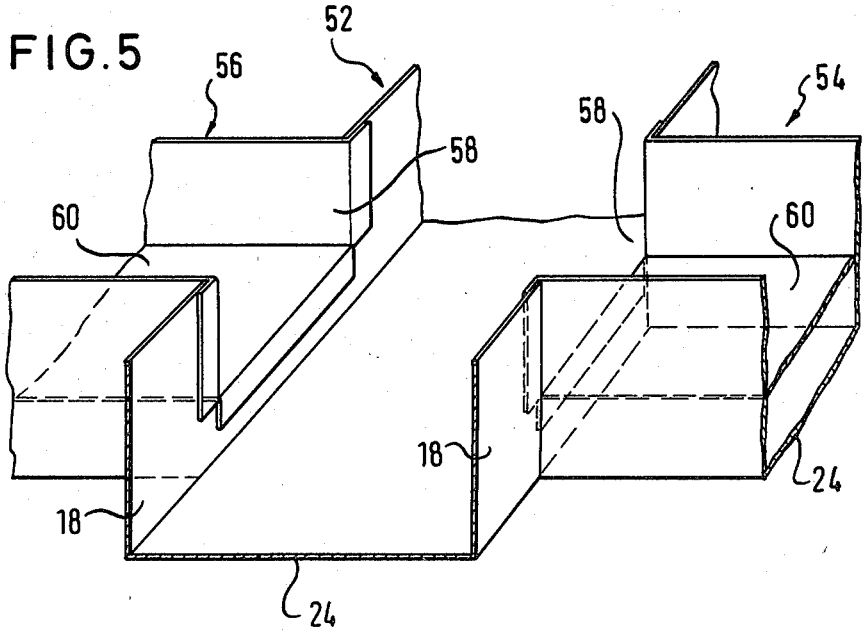
FIG. 5 is an embodiment of the cross point of collecting channels.

As shown in the drawings, particularly in FIGS. 2 and 4, ceiling elements 12 extend with their side edges 14 into collecting channels 16, which are open at the top facing the ceiling side. In the embodiment of FIG. 2, collecting channels 16 have two parallel side walls 18 ending in a V-shaped base part 20. In FIGS. 4 and 5, however, the collecting channels are U-profiles, and their side walls or their legs 18 are connected by a crosspiece 24 running perpendicular to them.

The edges 14 of ceiling elements 12 are fitted into cruciform support pieces 30, maintaining the spacing from walls 18 of collecting channels 16 and base parts 20 or 24. At the same time, the distance between adjacent edges 14 of ceiling elements 12 is fixed by support pieces 30, and an opening or slit of predetermined size is formed.

Collecting channels 16 are arranged below ceiling elements 12 along edges 14. Thus, on the corners of ceiling elements 12, cross points of collecting channels run in perpendicular directions to each other. Also, cruciform connecting pieces 34 or T-shaped connecting pieces 36 are provided for holding collecting channels 16 together at the crossing points.

Covering 10 of ceiling elements 12 is suspended from the supporting ceiling 37. A cruciform suspending part 38 with four arched legs 40 is provided for this purpose. The part 38 is affixed to the supporting ceiling 37 and has a borehole 42.

The borehole is preferably, defined by a sleeve, starting from the bottom of the collecting channels and running at least up to the height of the upper edge of the connecting piece or collecting channel. FIG. 4 shows such a borehole defined by a sleeve 26, which borehole provides an attachment means for the suspension of the covering according to the invention and may also be used for supply lines like electric cables, for example. The upper opening of sleeve 26 of course must be located above the top edge of legs 18, in order to prevent any escape of liquid through the borehole surrounded by sleeve 26, when the collecting channel is completely filled with liquid.

At a cross point of e.g. four ceiling elements 12, they are nested with their side edges 14 in a cruciform support piece 30. A cruciform connecting piece 34 is pressed from below against the collecting channels, said piece 34 having a borehole through which can be fitted a plug bolt 44, a long screw or some other fastening means which extends into the borehole in suspending part 38. Suspension part 38, with its four arched legs 40, presses against collecting channels 16. The force of pressure of the connecting piece 34 against the collecting channels 16 is regulated by the adjustable engagement of plug bolt 44 or the like in suspension part 38. Collecting channels 16 with their connecting pieces 34 or 36 are arranged at the same level at some distance from the floor. Preferably, collecting channels 16 will be connected at discharge to a spout pipe in order to drain the liquid off into a collecting tank or gutter.

FIG. 5 shows another embodiment of a cross point of intersecting collecting channels. Here, the collecting channels are U-profiles which, as aforementioned, are composed of sides 18 running parallel to each other and crosspiece 24 connecting sides 18. The diagram of the collecting channels is of a main collecting channel or a first collecting channel 52, into which discharge the subsidiary or second collecting channels 54 and 56. In order to provide a simple passage between collecting channels 54 and 56 to collecting channel 52, notches 58 are arranged in sides 18 of collecting channel 52, in which notches are nested the adjoining ends of subsidiary collecting channels 54 or 56. Thus, the width of notches 58 equals the inside spacing between the sides of collecting channels 54 or 56. Obviously, the joinder between the collecting channels is designed in a liquid-tight manner to prevent the penetration of liquids therethrough. For this purpose, the edges of collecting channels 54 or 56, for example, are bent in such a manner as to engage against the inside walls of sides 18. Then the bent edges can be joined to the walls of the sides by any fastening means. Preferably, it is then possible to place a sealing compound in the overlapping areas between the walls of the sides and the bent edges.

Now, in order to be able to conduct the liquids collected by collecting channels 54 or 56 and flowing along these channels without any difficulty into first collect channel 52, an intermediate bottom 60 is provided in each collecting channel 54 and 56 running parallel to the crosspiece 24, and its distance from the crosspiece equals the height between crosspiece and lower edge of notch 58. Consequently, the liquid flowing along the intermediate bottom 60 can still easily flow off into the collecting channel 52. Intermediate bottom 60, of course, cannot be seen by the viewer of the covering, and the optically standard and regular appearance of the covering according to the invention is not disturbed.

Within the vault of every ceiling element is found at least one sprinkling element 46, preferably in the form of a sprinkler head or nozzle, into which liquids, preferably extinguishing liquids, are supplied via a conduit system (not shown). The sprinkler element 46 is designed such that it is possible that the liquid to be delivered coats not only the surface of ceiling elements 12 facing the room but also the surfaces facing the ceiling. The liquids delivered by sprinkler elements 46 are subsequently collected in collecting channels 16 or 52, 54, 56, to be drained off.

As can be learned from FIG. 2, damming plates 48 are arranged in the cross area of collecting channels 16, thus within cruciform connecting pieces 34 or T-shaped connecting pieces 36, the liquid level in the collecting channels 16 can be adjusted. This offers the advantage that the air being sucked from the rooms, which has to pass through the exhaust joints or slits that are defined by the distances between channels 14 of ceiling elements 12 and sides 18 of collecting channels 16, will more or less come into contact with the liquid. Thus, a cooling takes place. This is especially advantageous for instance if a fire has broken out and dense fumes must be sucked off. With the cooling, the smoke can be sucked off through conventional exhaust fan means above the covering, which normally would be put out of operation if the fumes are of too high temperature. Damming plates 48 can even be so configured that the joints or slits between edges 14 and sides 18 are completely sealed. In order to suction off air or fumes from below covering 10, there must be a prevailing low pressure above covering 10.

As can be learned from FIG. 4, the area between adjacent ceiling elements is provided with a dirt trap 50, in order to guarantee that the area between collecting channels 16 and ceiling elements 12 through which the air or fumes are sucked will not be stopped up, which would jeopardize the operation capacity of covering 10 according to the invention. Thus, dirt trap 50, if desired, can be a protective screen or a perforated plate.

It will be briefly explained in the following that the covering according to the invention not only increases the fire resistance capacity of the supporting ceiling which is shielded by quick suction of the fumes which are present, but also prevents, e.g. extinguishing water from seeping through the ceilings, so that the next lower floor area will not be affected.

If, for example, a fire breaks out underneath a covering according to the invention, then the supporting ceiling above it will be shielded from any direct influence of the fire. An expansion of the fire to the supporting ceiling will be made difficult by the fact that covering 10 composed of ceiling elements 12 is sprinkled and coated with liquid. This sprinkling makes it more difficult for the fire to spread out toward the ceiling, where not only the surface turned toward the room but also the surface turned toward the ceiling can be coated with a liquid film.

The liquids flowing along the surfaces of ceiling elements 12 will reach a collecting channel which is configured in such a manner that the liquid does not flow off immediately, but rather can be dammed up therein to a desired volume. This will result in the advantage that the air or the dense smoke filling the room, being sucked off through the joints or slits formed between the collecting channels and the edges of the ceiling elements, will be cooled so as to guarantee that the exhaust fans will continue to be in working order, as the sucked off air or smoke does not have an inadmissibly high temperature. Due to the fact that covering 10 is composed of a plurality of ceiling elements 12, and therefore the exhaust slits are uniformly distributed over the entire area of the ceiling, the smoke originating from the center of the fire is sucked up directly in vertical or almost vertical direction upward to the ceiling. With this provision, one does not run the risk of filling the entire room with smoke and fumes, which could give rise to a risk of poisoning the persons present in that room.

In addition, covering 10 prevents extinguishing water from a story located above said covering from entering the room shielded by said coverings. The water penetrating a ceiling is conducted along the ceiling-side surfaces of the ceiling elements into collecting channels 16 or 52, 54, 56, in order to then be conducted into a collecting tank, for example. Thus, it is guaranteed that the damage caused by a fire will be restricted to only one story, and no damage can be caused by extinguishing water in the lower stories.

We claim:

1. A suspended, fire-resistant covering for a supporting ceiling, said covering defining a space between said covering and said ceiling, said covering comprising arched ceiling elements with upper and lower surfaces and peripheral side edges, sprinkling elements mounted for discharge of liquid toward at least one surface of each ceiling element, collecting channels receiving the side edges of and supporting the ceiling elements, said collecting channels receiving liquid discharged from said sprinkling elements, and means maintaining a spacing between the side edges of the ceiling elements and the collecting channels receiving said side edges.

2. Covering as in claim 1, wherein ceiling elements are arched in the shape of a cross arch.

3. Covering as in claim 1, wherein said sprinkling elements coats at least one surface of each ceiling element with a liquid coating.

4. Covering as in claim 2, wherein said collecting channels meet at crossing points, cruciform connecting pieces and T-shaped connecting pieces connecting said collecting channels at the crossing points, and retaining plates mounted in these connecting pieces to dam liquid received in the collecting channels.

5. Covering as in claim 4, wherein each of said cruciform connecting pieces is pressed from below against the corresponding collecting channels and has a borehole therethrough, and cruciform suspension pieces with curved legs, which suspension pieces press from above against said collecting channels at the crossing points of the collecting channels.

6. Covering as in claim 5, wherein a support piece in the collecting channels at each crossing point accommodates the edges of ceiling elements.

7. Covering as in claim 1, wherein said ceiling elements in the area of said collecting channels are provided with dirt traps.

8. Covering as in claim 1, wherein the collecting channels comprise first collecting channels having side notches formed therein and second collecting channels, arranged parallel to each other, nested in the notches in the first collecting channels to define the crossing points.

9. Covering as in claim 8, wherein the second collecting channels have an intermediate bottom at a height aligning with the notches.

10. Covering as in claim 8, wherein each of said collecting channels includes a bottom and sides with upper edges, sleeves extending from the bottoms of the collecting channels to at least said upper edges, said sleeves defining openings to accommodate fastening means for the covering and supply lines.

* * * * *